United States Patent [19]

Scriber

[11] Patent Number: 4,663,861

[45] Date of Patent: May 12, 1987

[54] DRYER CONTROL WITH MOMENTARY TUMBLE FEATURE

[75] Inventor: Chris A. Scriber, St. Joseph, Mich.

[73] Assignee: Whirlpool Corporation, Benton Harbor, Mich.

[21] Appl. No.: 829,961

[22] Filed: Feb. 14, 1986

[51] Int. Cl.[4] ..... E16B 25/00

[52] U.S. Cl. ..... 34/22; 34/56; 34/133

[58] Field of Search ..... 34/52, 56, 133, 22

[56] References Cited

U.S. PATENT DOCUMENTS

| | | | |
|---|---|---|---|
| 3,391,467 | 7/1968 | Miller et al. | 34/45 |
| 3,471,938 | 10/1969 | Elders | 34/45 |
| 3,540,241 | 11/1970 | Jacobs | 68/12 |
| 4,132,008 | 1/1979 | Deschaaf | 34/45 |
| 4,132,009 | 1/1979 | Bochan | 34/45 |
| 4,152,840 | 5/1979 | Stille | 34/56 |
| 4,312,138 | 1/1982 | Ellington | 34/45 |
| 4,467,530 | 8/1984 | Fesmire et al. | 34/8 |
| 4,493,156 | 1/1985 | Siegmann | 34/56 |
| 4,509,275 | 4/1985 | Coffman et al. | 34/56 |

*Primary Examiner*—Albert J. MaKay
*Assistant Examiner*—David W. Westphal
*Attorney, Agent, or Firm*—Hill, Van Santen, Steadman & Simpson

[57] ABSTRACT

An automatic clothes dryer includes a dryer control circuit having at least one manually operable switch for initiating momentary tumbling of a dryer drum after the end of a drying cycle. A lock-out relay disconnects power from a main motor winding of the dryer drum drive motor upon the motor reaching operating speed so that the rotation of the dryer drum is restricted to less than a complete revolution of the drum, thereby to reposition any random articles in the drum for more convenient removal.

18 Claims, 4 Drawing Figures

DRYER CONTROL WITH MOMENTARY TUMBLE FEATURE

BACKGROUND OF THE INVENTION

1. Field of the Invention

The present invention relates generally to an automatic clothes dryer control circuit having a manually operable switch for selectively providing a brief or momentary rotation of a dryer drum.

2. Description of the Prior Art

It is known to automatically provide periodic tumbling of a clothes load in a dryer just prior to completion of a drying cycle to prevent wrinkles from forming in the dried clothes. For instance, U.S. Pat. No. 3,391,467 discloses an anti-wrinkle control in which intermittent tumbling for a duration of about five to ten seconds automatically occurs at a particular dryer setting every four or five minutes near the conclusion of a drying cycle.

SUMMARY OF THE INVENTION

The present invention provides means for enabling clothes to be easily removed from a dryer and, in particular, from the back of a dryer drum. A manually operable switch, when actuated, causes approximately one or less revolutions of a dryer drum in an automatic clothes dryer after the conclusion of a drying operation. The limited rotation enables any remaining items at the back of the drum or resting on a dryer drum baffle to be brought into view, or redistributed within the drum. Such redistribution frequently causes items, such as articles of clothing, resting in the back portion of the dryer drum to be brought within reach so that they may be more easily removed.

The present invention ensures that only a brief tumbling action will occur each time the manually operable switch is actuated, regardless of the duration of the switch actuation. Actuation of the momentary tumble switch initiates operation of the dryer motor, preferably only for the duration of its starting cycle, after which the motor is de-energized. The momentary tumble can be initiated when the dryer is not on, such as after the conclusion of the drying cycle, without operation of the main dryer control switch, a particular advantage in coin-operated machines in which the main dryer control is not operable after run-out of the drying cycle without requiring additional coins to be deposited.

The momentary tumble control may either be a switch mounted on the dryer console or, for convenience, a switch mounted adjacent the dryer drum opening for operation while removing clothes. The switch is preferably mounted inside the door opening so that it is only operable when the dryer door is open.

In another embodiment, a pair of switches are included mounted on either side of the dryer drum opening, both of which must be operated simultaneously for activation of the momentary tumble feature. Such simultaneous activation provides an added measure of safety by ensuring that both of the user's hands are outside of the dryer drum during the momentary tumble action.

The present momentary tumble feature may be included in a wide variety of dryer circuits. The energization of the dryer motor is preferably limited in time by the action of the centrifugal switch associated with the dryer motor. Thus, only a few additional parts are required for implementation of the present invention with facility and at low cost.

DESCRIPTION OF THE PREFERRED EMBODIMENTS

Figure 1:
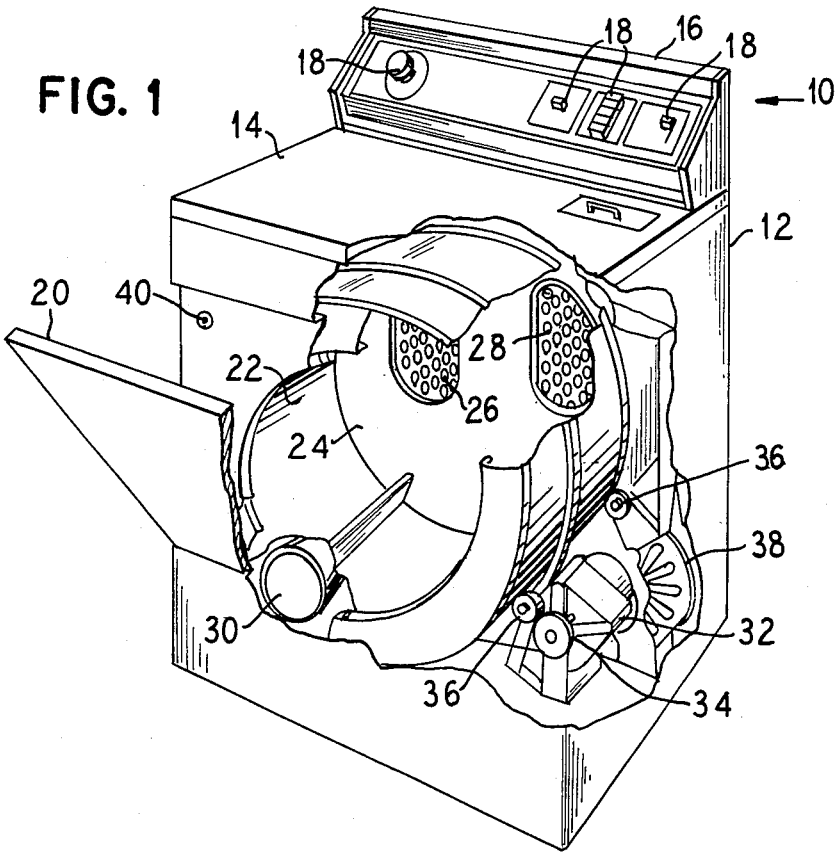
FIG. 1 is a perspective view of an automatic clothes dryer, partially cut away, including a momentary tumble apparatus according to the principles of the present invention.

In FIG. 1, there is generally shown an automatic clothes dryer at 10 having an exterior cabinet 12 with a top panel 14 having a control console 16 along the rear portion thereof incorporating a plurality of controls 18 for selecting an automatic programmed series of drying steps. The dryer cabinet 12 has a front openable door 20 providing access to the interior of a rotatable drying drum 22 which rotates about a horizontal axis, and has a non-rotating rear bulkhead 24 with air intakes 26 and air outlets 28 therein for charging the interior of the drum 22 with heated air from a heat source 30 and for exhausting moisture laden air. An electric motor 32 is provided to rotate the drum 22 through a pulley arrangement 34, the drum rotating on a plurality of rollers 36. The motor 32 also drives the fan 38 which provides the air flow through the interior of the drum 22. A momentary tumble switch 40 is provided on the cabinet 12 adjacent the dryer drum 22 opening.

Figure 2:
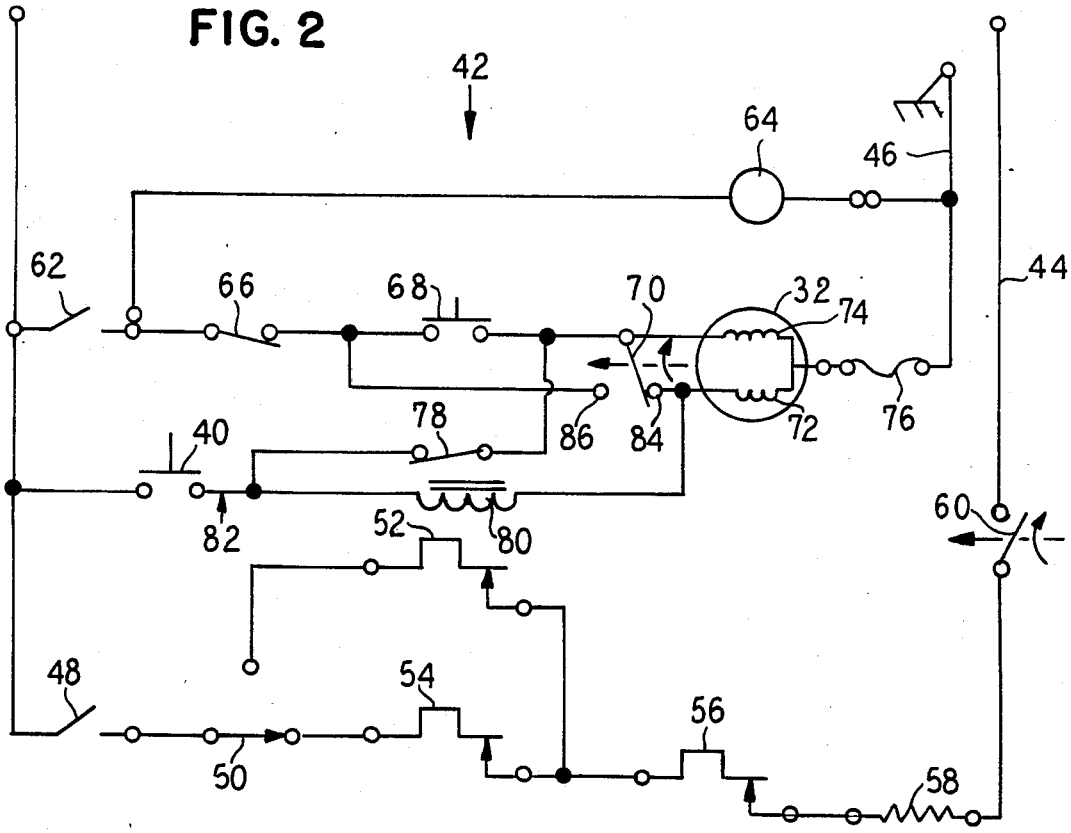
FIG. 2 is an electrical circuit diagram of one embodiment of an automatic dryer control including the momentary tumble apparatus of the present invention.

FIG. 2 shows an electrical dryer control circuit 42 for use in the dryer 10 of FIG. 1 that includes a high voltage branch 44 and a low voltage branch 46. In a preferred embodiment, the high voltage branch 44 is connected across approximately 240 volts and the low voltage branch is connected across approximately 120 volts. The high voltage branch includes a timer contact 48, which is one of several in the control circuit 42, a temperature selection switch 50 for selecting one of a pair of operating thermostats 52 and 54, a high temperature thermostat 56, a heater 58 and a centrifugal switch 60. The low voltage branch 46 includes a second timer contract 62 and a timer motor 64 which is arranged to operate each of the timer contacts and, thereby, control each of several drying cycles.

A door switch 66 and a push-to-start switch 68 used to initiate operation of the drive motor 32 are also located in the low voltage branch 46. The drive motor 32 includes a centrifugal switch 70 mounted therein and connected to control the application of power to a start winding 72 during a starting cycle. A main drive winding 74 is also included in the drive motor 32 and a fuse 76 completes the low voltage branch 46 of the dryer control circuit 42.

The momentary tumble feature of the present invention is provided by the tumble switch 40 in conjunction with a normally closed tumble lock-out contact 78 that is operated by a tumble lock-out relay 80 connected in a tumble circuit portion 82 in the low voltage branch 46. The tumble lock-out relay 80 is connected so that current flowing through tumble switch 40 is carried therethrough to the start winding 72 of the drive motor 32, while the tumble lock-out contact 78 is connected to provide a shunt around the lock-out relay 80 when the centrifugal switch 70 is in a start-up position.

The tumble circuit portion 82 enables power to be selectively applied momentarily to the motor 32 to initiate a limited rotation of the dryer drum 22. However, after a brief activation, power is disconnected from the main motor winding 74, resulting in generally less than one complete rotation of the dryer drum 22.

More specifically, after an automatic drying cycle has been completed and the timer contacts 48 and 62 are in their open positions, the dryer drum 22 may be briefly rotated to cause articles within the dryer drum 22 to move to a more accessible location for easy removal. The tumble switch 40 is actuated, enabling current to flow therethrough and through the normally closed tumble contact 78 to the start winding 72 and drive winding 74 of the motor 32. The lock-out relay 80 is shunted out of the circuit by the tumble contact 78 and the centrifugal switch 70 so that virtually no current flows through the relay 80. Current flow through the windings 72 and 74 causes the motor 32, and thus the drum, to rotate.

When the motor reaches its operating speed, the centrifugal switch 70 is thrown from its start-up position at a contact 84 to its operating position at a contact 86. The switching of the centrifugal switch 70 removes the shunt from the lock-out relay 80 and places the lock-out relay 80 in series with the start winding 72. Current flow through the lock-out relay 80 causes it to open the tumble contact 78, thereby removing power from the drive winding 74. Since the motor 32 will not operate with power applied only to the start winding 72 through the relay 80, rotation of the motor 32 is stopped and the momentary tumbling action of the dryer drum 22 likewise ceases.

As long as the tumble switch 40 remains operated, current flows through the lock-out relay 80 keeping the switch 78 open and inhibiting rotation of the motor 32. Only by releasing the tumble switch 40 and reactivating it can the momentary tumbling again be initiated. Opening of the tumble switch 40 removes the current flow through the lock-out relay 80 and enables the tumble contact 78 to close so that closing of the switch 40 will cause another momentary tumbling.

Figure 3:
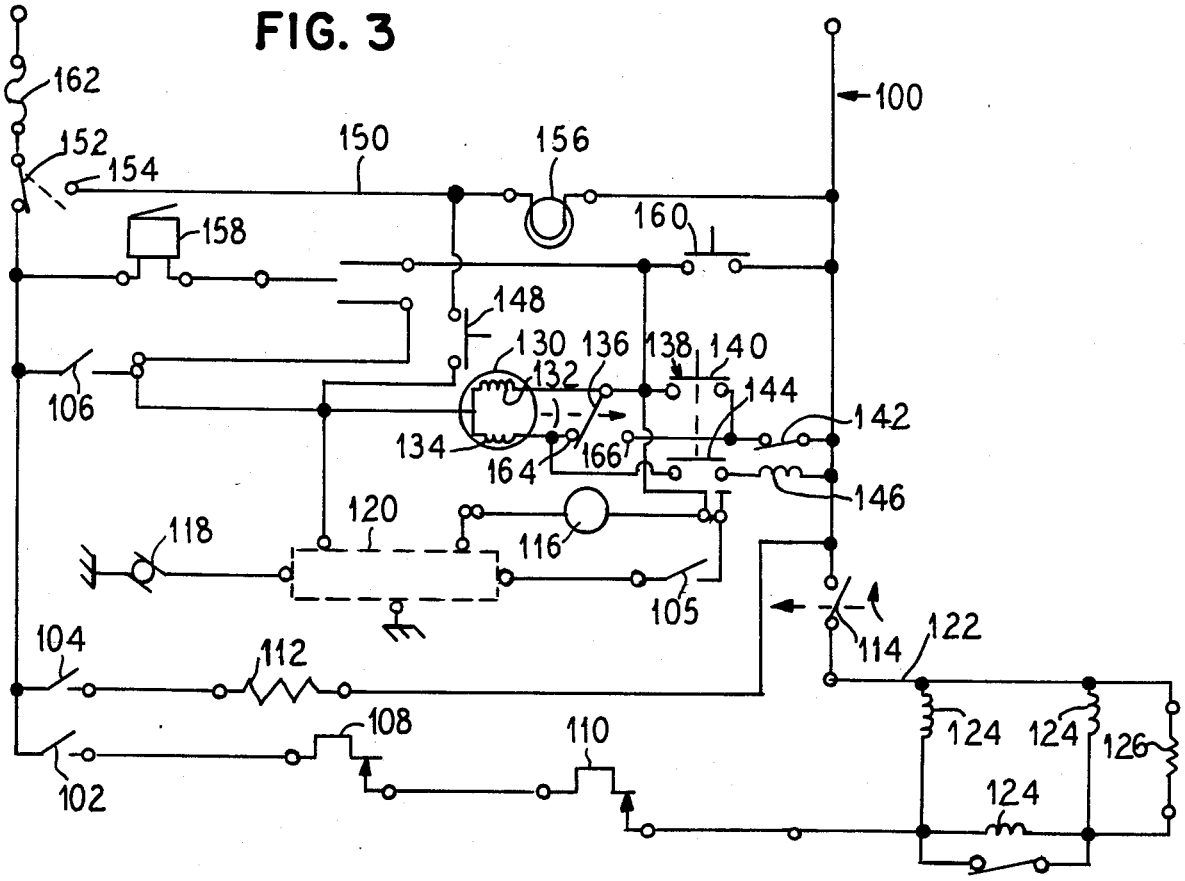
FIG. 3 is an electrical circuit diagram of a dryer control including a second embodiment of the momentary tumble apparatus of the present invention.

In FIG. 3, an embodiment of a dryer control circuit 100 for use with a gas heated dryer is shown. The circuit 100 includes a plurality of timer contacts 102, 104, 105 and 106, thermostats 108 and 110, a thermostat bias heater 112 mounted adjacent thereto, a centrifugal switch 114, a timer motor 116, a dryness sensor 118, and a conventional electronic dryness control unit 120. A gas control portion 122 includes valve operating coils 124 and a gas igniter 126.

A drive motor 130 includes a main winding 132 and a start winding 134, as well as a centrifugal switch 136. A double pole, single throw tumble switch 138 is connected at a first pole 140 to a normally closed tumble contact 142 and at a second pole 144 to a lock-out relay 146 which operates the contact 142. A second tumble switch 148 is included and is connected in a circuit portion 150 that is empowered by the movement of a door switch 152 to a door open position at a contact 154. A drum lamp 156 is included in the circuit portion 150, and a buzzer 158, a push-to-start switch 160, and a fuse 162 complete the dryer control circuit 100.

In the dryer control circuit 100, the momentary tumble feature only operates when the door switch 152 is in the door open position at contact 154. Movement of the door switch 152 to contact 154 disconnects power from a major portion of the circuit 100, so that only the drum light 156 and the circuit elements necessary for the momentary tumble operation are operable.

Both of the tumble switches 138 and 148 must be closed simultaneously to supply power to the motor 130. When power is first applied to the motor 130, the lock-out relay 146 is shunted, as before, by the tumble contact 142, the first pole 140 of the tumble switch 138 and the centrifugal switch 136. When the motor 130 reaches full operating speed, the centrifugal switch 136 is thrown from a start-up position at a contact 164 to an operating position at a contact 166. The shunt is thereby removed and current flows through the start winding 134, through the second pole 144 of the tumble switch 138, and through the lock-out relay 146, which activates the lock-out relay 146 to cause the tumble contact 142 to open. The opening of tumble contact 142 removes power from the main winding 132 and causes the motor 130 to stop. The motor 130 remains stopped until one or both of the tumble switches 138 and 148 are opened and reclosed.

Figure 4:
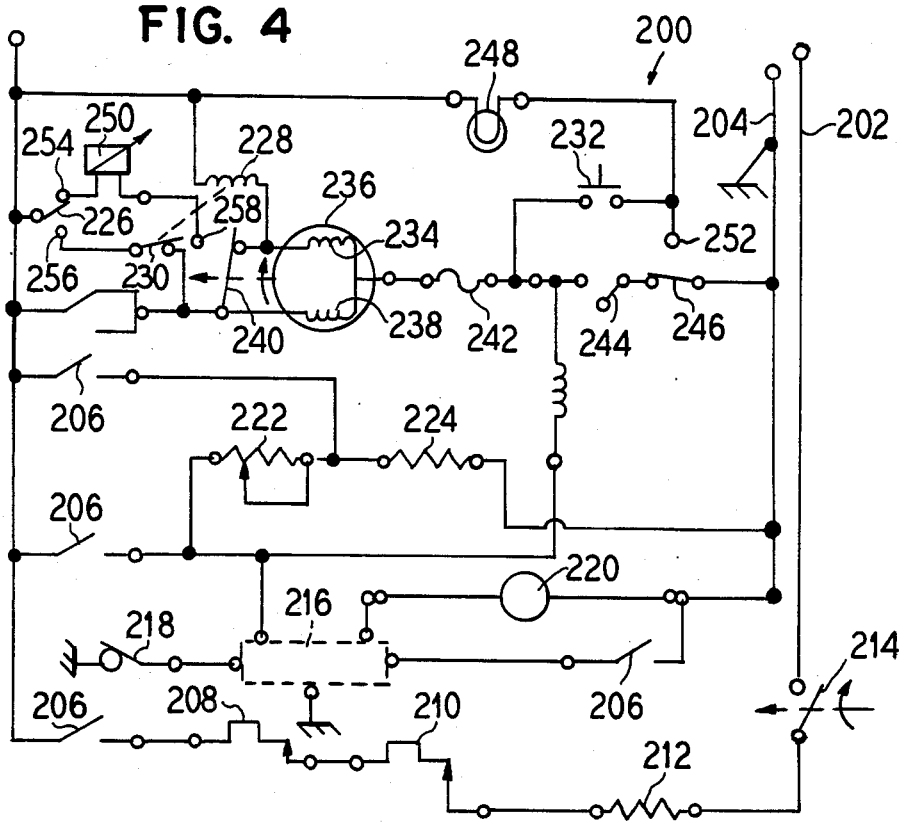
FIG. 4 is an electrical circuit diagram of a dryer control including a third embodiment of the present momentary tumble apparatus.

The preferred embodiment of a control circuit 200 is shown in FIG. 4, and includes a high voltage branch 202 and a low voltage branch 204. In the high voltage branch 202, a timer switch 206 is connected in series with an operating thermostat 208 and a high temperature limit thermostat 210, as well as a heater 212 and centrifugal switch 214. The low voltage branch 204 includes an electronic dryness control 216 with a sensor 218 and a timer motor 220 for controlling the timer contacts. A variable temperature switch 222 and thermostat heater bias 224 are also connected in the low voltage branch 204.

The momentary tumble feature is implemented in the preferred embodiment by a first tumble switch 226, which is a single pole, double throw switch, a lock-out relay 228 and an associated tumble contact 230, and a second tumble switch 232. As before, the lock-out relay 228 is connected in series with a start winding 234 of a drive motor 236 and the tumble contact 230, which is operated by the relay 228, is in series with a main winding 238 of the drive motor 236 that includes a centrifugal switch 240. A fuse 242, a push-to-start switch 244, a door switch 246, a drum lamp 248, and a buzzer 250 completes the control circuit 200.

After a drying cycle has been completed and the dryer door 20 opened so that the door switch 246 is moved to a door open position at contact 252, a momentary tumbling operation may be caused to occur by simultaneous operation of both tumble switches 226 and 232. Operation of the tumble switch 226 closes the contact 256. If the tumble switch 232 is closed, a circuit is completed through both the start winding 234 and the main winding 238, through the fuse 242, the tumble switch 232, and the door switch 246, and the motor 236 operates to rotate the dryer drum 22. When the motor 236 reaches operating speed and the centrifugal switch 240 is thrown to its operating position 258, the lock-out relay 228 is activated. The lock-out relay 228 opens the tumble contact 230, thereby removing power from the main winding 238 and stopping the motor 236. As before, the motor 236 remains stopped and another momentary tumble cannot be initiated until at least one of the tumble switches 226 and 232 is opened and reclosed.

Two tumble switches are provided in each of the embodiments shown in FIGS. 3 and 4. When the tumble switches are mounted at spaced locations on the dryer cabinet 12, they ensure that a user of a dryer so equipped will have one hand on each of the switches and, thus, will not have a hand inside the drum 22 at the time it is rotated. In a preferred embodiment, the tumble switches are mounted on either side of the dryer cabinet 12 at the portion hidden by the closed dryer door 20. The switches are, thus, inaccessible during normal dryer operation and are easily reached while removing clothes from the dryer 10. However, it is also foreseen to mount the tumble switch(es) at other locations on the dryer cabinet 12 as well, including on the control console 16.

The present invention provides means for redistributing a dryer load so that it may be easily removed from the dryer drum 22. Only a brief drum rotation is provided for each activation of the tumble switch(es), regardless of how long the switch(es) is (are) closed. In the embodiments having two tumble switches, both switches must be closed simultaneously for the momentary tumble function to be initiated. In practice, it has been found that the activation of the tumble switch(es) causes approximately 270 degrees of drum rotation. While the amount of drum rotation provided is not believed to be particularly critical, this amount of rotation generally redistributes articles which are resting on a dryer drum baffle or which are at the back of the dryer drum 22 to a more easily accessible position.

As is apparent from the foregoing specification, the present invention is susceptible to being embodied with various alterations and modifications which may differ particularly from those that I have described in the preceding specification and description. It should be understood that I wish to embody within the scope of the patent granted hereon all such modifications as reasonably and properly come within the scope of my contribution to the art.

The embodiments of the invention in which an exclusive property or privilege is claimed are defined as follows:

1. A dryer control circuit for use in an automatic clothes dryer having a horizontally rotatable dryer drum for tumbling articles during drying, comprising:

user operable means for initiating a horizontal rotation of the dryer drum after a drying cycle; and means for automatically interrupting the horizontal rotation of the dryer drum shortly after such rotation begins.

2. A control circuit as claimed in claim 1, wherein said means for initiating rotation includes two mutually spaced manually operable switches.

3. A control circuit as claimed in claim 1, wherein said means for automatically interrupting includes a relay connected for energization when a predetermined rotational speed of said dryer drum is reached and when said user operable means is operated and an associated relay contact operable upon energization of said relay to interrupt the horizontal rotation of said dryer drum.

4. A dryer control circuit for use in a dryer including a rotatable dryer drum for tumbling articles and a drive motor for rotating the dryer drum and having a main winding, a start winding, and a centrifugal switch for automatically disconnecting the start winding when the drive motor reaches a predetermined speed, comprising:

at least one manually operable tumble switch connected to selectively supply power to both the start winding and the main winding of the drive motor when the centrifugal switch is in a start-up position; and means for automatically disconnecting from power at least the main winding in response to movement of the centrifugal switch from a start position, whereby operation of said at least one tumble switch causes a limited duration rotation of the dryer drum.

5. A control circuit as claimed in claim 4, further comprising:

a tumble lock-out relay connected in series with the tumble switch and the start winding; and, a tumble contact connected in series with the main winding and operable by said lock-out relay.

6. A control circuit as claimed in claim 5, wherein said tumble contact is normally closed.

7. A control circuit as claimed in claim 4, including first and second tumble switches connected to supply power to the drive motor only when both said first and second tumble switches are simultaneously operated.

8. A dryer control circuit for use in an automatic clothes dryer having a rotatable dryer drum driven by a drive motor which includes a start winding and a main winding as well as a centrifugal switch, an openable door mounted on a dryer cabinet to provide access to the dryer drum, and a door switch mounted for operation in response to the door being in a closed position, comprising:

a manually operable tumble switch connected to selectively supply power to both the start winding and the main winding when the centrifugal switch is in a start-up position;

a tumble lock-out relay connected between the start winding and said tumble switch; and a normally closed tumble contact operable by said lock-out relay and being connected between said tumble switch and the centrifugal switch to shunt said lock-out relay when the centrifugal switch is in a start-up position, whereby operation of said tumble switch causes rotation of the dryer drum until the centrifugal switch is moved toward its operating position.

9. A dryer control circuit as claimed in claim 8, wherein said tumble switch is mounted on the dryer cabinet inside the openable door.

10. A dryer control circuit for use in an automatic dryer including a rotatable dryer drum driven by a drive motor having a start winding and a main winding as well as a centrifugal switch, an openable door mounted over an access opening in a dryer cabinet to provide access to the dryer drum, and a door switch mounted for operation in response to the door being in a closed position, comprising:

first and second manually openable tumble switches connected to supply power to both the start winding and the main winding when the openable door is in an open position and the centrifugal switch is in a start-up position, said first tumble switch including first and second poles, said first pole being connected to the start winding, said second pole being connected to said centrifugal switch;

a tumble lock-out relay connected to said first pole of said first tumble switch; and a normally closed tumble contact operable by said lock-out relay and being connected to said second pole of said first tumble switch, said tumble contact forming a shunt past said lock-out relay when said first tumble switch is closed and the centrifugal switch is in a start-up position, whereby simultaneous closing of said first and second tumble switches causes rotation of the dryer drum until the centrifugal switch is thrown toward its operating position.

11. A dryer control circuit as claimed in claim 10, wherein said first and second tumble switches are mounted on the dryer cabinet on opposite sides of the access opening.

12. A dryer control circuit for use in an automatic dryer including a rotatable dryer drum driven by a drive motor having a start winding and a main winding as well as a centrifugal switch, and openable door mounted over an access opening in a dryer cabinet to provide access to the dryer drum, and a door switch mounted for operation in response to the door being in a closed position, comprising:

first and second manually operable tumble switches connected to supply power to both the start winding and the main winding when the door is in an open position and the centrifugal switch is in a start-up position;

a tumble lock-out relay connected to supply power to the start winding of the motor; and a tumble contact connected between said first tumble switch and the centrifugal switch and being operable by said lock-out relay, said tumble contact forming a shunt past said lock-out relay when said first tumble switch is operated and when the centrifugal switch is in a start-up position, whereby simultaneous closing of said first and second tumble switches causes rotation of the dryer drum until the centrifugal switch is thrown toward its operating position.

13. The method of operating a domestic clothes dryer which includes the steps of:

(1) energizing selectively an electric drive motor to drive a rotatable drum about a horizontal axis through a cycle of selected duration;

(2) simultaneously directing a stream of temperature conditioned air through the dryer to entrain moisture from the articles tumbling in the drum;

(3) terminating steps (1) and (2) at the conclusion of a preset control cycle;

(4) removing some of the dried articles from the drum; and (5) temporarily and momentarily energizing said electric drive motor to selectively drive said drum about said horizontal axis through less than one complete revolution, thereby to physically readjust the contents of the drum for facilitating removal of the remaining dried articles by the operator.

14. A domestic clothes dryer comprising:

an electric motor driven drum type dryer having a treatment zone and means for directing a stream of temperature conditioned air through said zone to entrain mositure from articles tumbling in the drum, the drum being rotatable on a horizontal axis;

presettable sequential control means for operating said dryer by energizing said electric motor selectively during a selected program of controlled duration;

a door controlling access to said treatment zone; and a supplemental momentary control switch means selectively actuatable by an operator for temporarily and momentarily energizing and driving said electric motor driven drum through less than one complete horizontal revolution, thereby to physically readjust the contents of the drum for facilitating removal thereof by the operator.

15. A domestic clothes dryer comprising:

an electric motor driven rotatable drum type dryer having a treatment zone and means for directing a stream of temperature conditioned air through said zone to entrain mosture from articles tumbled in said drum;

presettable sequential control means for operating said dryer by energizing said electric motor selectively during a selected program of controlled duration;

a door controlling access to said treatment zone; and a supplemental momentary control switch means selectively actuatable by an operator for temporarily and momentarily energizing and driving said electric motor driven drum through less than one complete revolution, thereby to physically readjust the contents of the drum for facilitating removal thereof by the operator, said supplemental momentary control switch means having an actuating portion located adjacent said door and arranged to be accessible only when said door is open.

16. A domestic clothes dryer comprising:

an electric motor driven rotatable drum type dryer having a treatment zone and means for directing a stream of temperature conditioned air through said zone to entrain moisture from articles tumbled in said drum;

presettable sequential control means for operating said dryer by energizing said electric motor selectively during a selected program of controlled duration;

a door controlling access to said treatment zone; and a supplemental momentary control switch means selectively actuatable by an operator for temporarily and momentarily energizing and driving said electric motor driven drum through less than one complete revolution, thereby to physically readjust the contents of the drum for facilitating removal thereof by the operator, said supplemental momentary control switch means having two manually operable actuating means spaced from each other and adjacent said door, requiring the operator to actuate both of said parts simultaneously.

17. A dryer control circuit for use in an automatic clothes dryer having a rotatable dryer drum, a drive motor for rotating said drum, motor speed sensing means for sensing when the motor has reached a predetermined speed, an openable door arranged to provide access to the dryer drum, and a door switch arranged to be actuated by movement of the openable door, comprising:

first and second power supply terminals;

a door switch contact arranged to be connected to one of said power supply terminals only when the door is in an open position;

a manually operable switch connected in series with said door switch contact;

a normally closed switch responsive to said motor speed sensing means and arranged to open when the motor reaches a predetermined speed, said switch being connected in series between the manually operable switch and the drive motor; and, circuit means connecting the drive motor with the second power supply terminal, whereby actuation of the manually operable switch when the dryer door is open effects momentary energization of the drive motor.

18. A dryer control circuit for use in an automatic fabric drying apparatus having a rotatable dryer drum, a drive motor for rotating the drum, the drive motor operating at full operating speed during a drying cycle of the drying apparatus, an openable door arranged to selectively close an access opening in a dryer cabinet for providing access to the dryer drum, and a door switch responsive to the position of the door, comprising:

a manually operable switch; and a circuit coupled to said manually operable switch and to said door switch and connected to energize said drive motor when said manually operable switch is actuated, said door switch connected in said circuit to prevent said drive motor from reaching full operating speed when said door is in an open position so that a momentary energization of said drive motor results.

* * * * *